US005655443A

United States Patent [19]

Hall

[11] Patent Number: 5,655,443

[45] Date of Patent: Aug. 12, 1997

[54] MOBILE CAR CRUSHER

[76] Inventor: Charlie Roy Hall, P.O. Box 190, Wadley, Ga. 30477

[21] Appl. No.: 646,730

[22] Filed: May 1, 1996

[51] Int. Cl.[6] ..... B30B 9/32

[52] U.S. Cl. ..... 100/100; 100/269.19; 100/901

[58] Field of Search ..... 100/46, 100, 255, 100/258 A, 269.19, 901

[56] References Cited

U.S. PATENT DOCUMENTS

| | | | |
|---|---|---|---|
| 3,404,622 | 10/1968 | Flanagan | 100/901 |
| 3,517,608 | 6/1970 | Tezuka | 100/901 |
| 3,757,680 | 9/1973 | Williams | 100/901 |
| 3,765,323 | 10/1973 | Hix | 100/901 |
| 3,844,209 | 10/1974 | Allbritton | 100/901 |
| 3,942,432 | 3/1976 | Cantine, Jr. et al. | 100/901 |
| 3,965,812 | 6/1976 | Oberg | 100/901 |
| 5,088,400 | 2/1992 | Ferguson | 100/269.19 |

FOREIGN PATENT DOCUMENTS

| | | | |
|---|---|---|---|
| 2029299 | 3/1980 | United Kingdom | 100/901 |

*Primary Examiner*—Stephen F. Gerrity

[57] ABSTRACT

A mobile car crusher (1) has two hydraulic cylinders (13, 20) with one at each end of a heavy-duty trailer. A cylinder base (14) on a bottom of each of the two hydraulic cylinders is positional hydraulically proximate a bottom of each of two cylinder-guide posts (7, 9) for travel mode and proximate a top of each of the two cylinder-guide posts for car-crusher operating mode. A hood end of each of two piston shafts (17) of each of two hydraulic pistons for the two hydraulic cylinders is attached to each of two shaft bases (19, 21) to which ends of a crusher hood (28) are attached in horizontal attitude. The two shaft bases are actuated to travel vertically for alternately car-crushing and car-acceptance action of the crusher hood in relation to a crusher floor (22) by travel of the two hydraulic pistons in hydraulic cylinders with cylinder bases fastened into an operating position proximate tops of the cylinder-post guides. With the cylinder bases unfastened from proximate tops of the plunger guides and with the cylinder bases resting at bottoms of the cylinder-guide posts, the hydraulic cylinders are actuated to travel vertically upward to position the cylinder bases for operative mode at tops of the plunger guides and to travel downward to position the cylinder bases for travel mode at bottoms of the plunger guides.

36 Claims, 8 Drawing Sheets

MOBILE CAR CRUSHER

BACKGROUND OF THE INVENTION

1. Field of the Invention

This invention relates to car crushers and in particular to a mobile car crusher which employs hydraulic crushing cylinders for quick convertibility of hydraulic bases between a lowered non-working mode for travel and a raised working mode for operation.

2. Description of Related Art

Various car crushers have been devised. None are known, however, to be convertible quickly and conveniently between a cylinder-raised working mode and a cylinder-lowered travel mode in a manner taught by this invention. An example of different car crushers in use is described in U.S. Pat. No. 3,404,622, issued to Flanagan on Oct. 8, 1968. The Flanagan patent taught a "mobile vehicle press" that required considerable time and effort for conversion between a work mode with hydraulic cylinders raised too high for highway travel and a travel mode with the hydraulic cylinders lowered for highway travel. Further, it was confined to less opening height and lower output rate than made possible by this invention.

Increased production and use of automobiles with designedly short use life and increased demand for scrap metal from junked cars are creating an increasingly strong demand for a mobile car crusher having efficiency competitive with large centralized car-crushing facilities. In addition, increased competitiveness in decentralized car crushing is creating further economic need for improved auto-crushing machinery that can be transported quickly and conveniently where and as desired.

SUMMARY OF THE INVENTION

In light of rapidly growing demand for efficient mobile car crushers and in light of their scant improvement in the past several decades, objects of this invention are to provide a mobile car crusher which:

Is convertible quickly and conveniently between a working mode with a hydraulic cylinder raised and a travel mode with the hydraulic cylinder lowered;

Has rubberlike-roller contact of crusher-hood attachments for arresting lateral tilt of the crusher hood in downward car-crushing travel; and Has automation options.

This invention accomplishes these and other objectives with a mobile car crusher having two hydraulic cylinders with one of the two hydraulic cylinders at preferably each of two sunken ends of a heavy-duty lowboy type of trailer. A cylinder base on a bottom of each of the two hydraulic cylinders is positional hydraulically proximate a bottom of each of two cylinder-guide posts for travel mode and proximate a top of each of the two cylinder-guide posts for operating mode. A hood end of shafts of each of two hydraulic pistons for the two hydraulic cylinders is attached to each of two shaft bases to which one of each of two ends of a crusher hood is attached horizontally. The two shaft bases are actuated to travel vertically for alternately material-crushing and material-acceptance action of the crusher hood in relation to a crusher floor by travel of the two hydraulic pistons in hydraulic cylinders with cylinder bases fastened into an operating position proximate tops of the plunger guides. With the cylinder bases unfastened from proximate tops of the cylinder-guide posts and with the shaft bases resting proximate bottoms of the cylinder-guide posts, the hydraulic cylinders are actuated to travel vertically upward to position the cylinder bases for fastening for operative mode at tops of the plunger guides and to travel downward to position the cylinder bases for travel mode at bottoms of the plunger guides. Automation controls and operative embodiments for various use conditions and preferences are provided.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
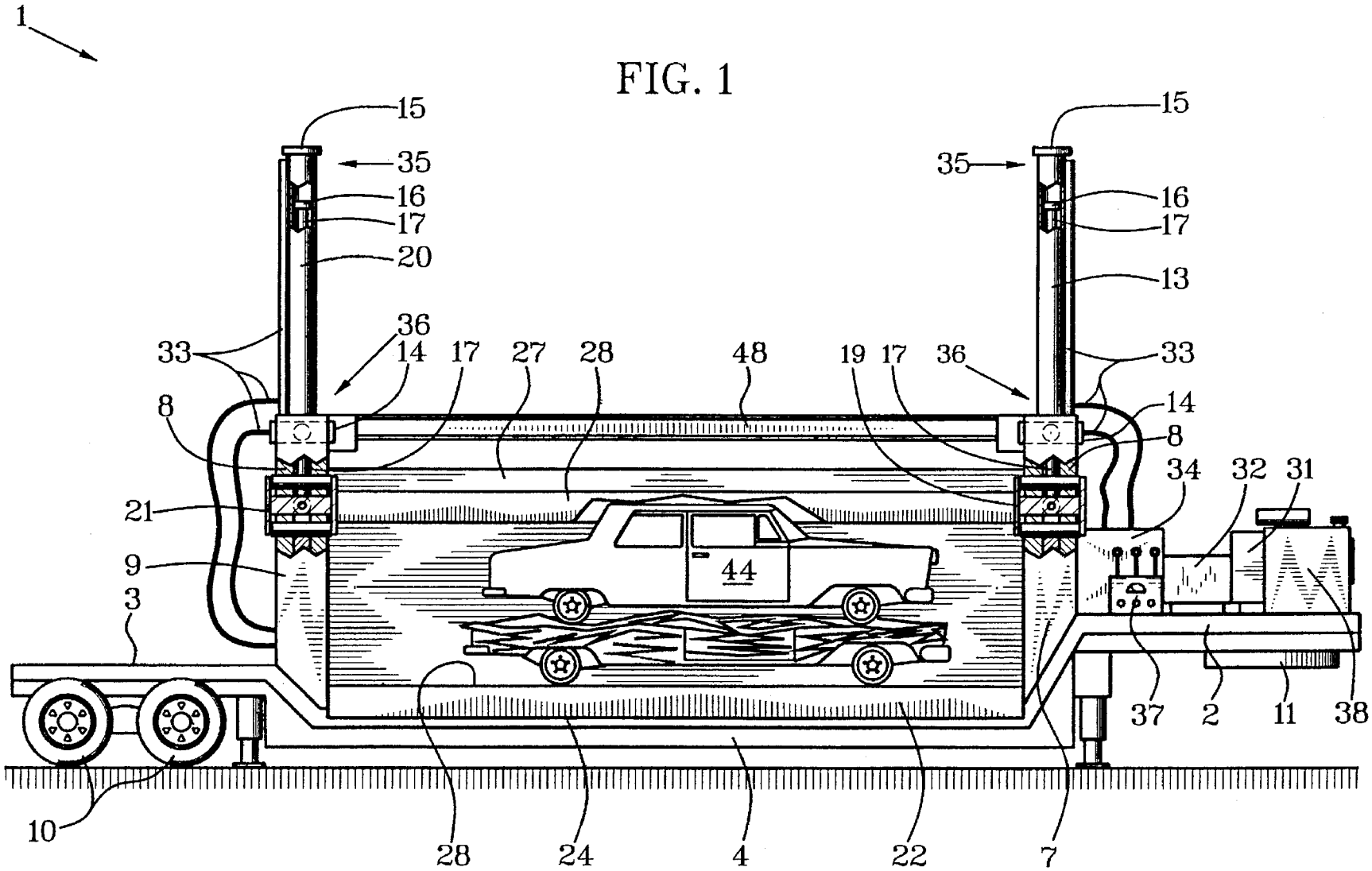
FIG. 1 is a partially cutaway side elevation view of this invention in an operative mode of crushing cars.
Figure 2:
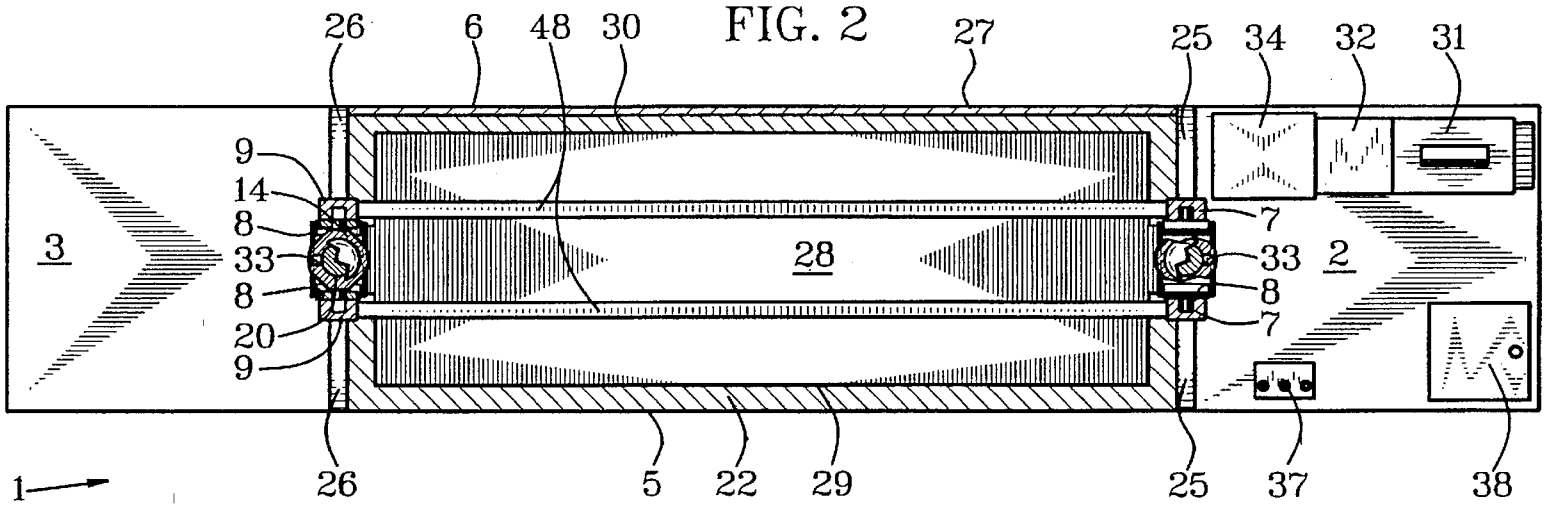
FIG. 2 is a partially cutaway top view in either operative or travel mode.
Figure 3:
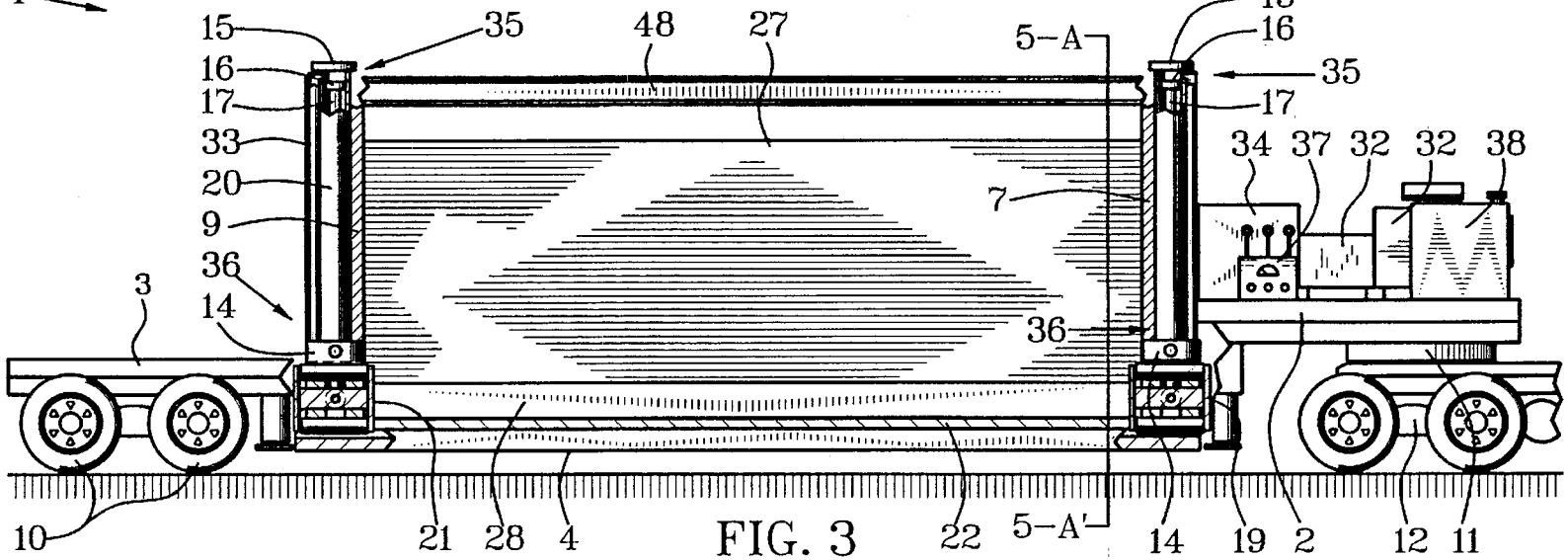
FIG. 3 is a partially cutaway side elevation view in travel mode.

Reference is made first to FIGS. 1–5. A mobile car crusher 1 with a mobile platform has a front base section 2, a rear base section 3, a car-crusher section 4 intermediate the front base section 2 and the rear base section 3, a first side 5 and a second side 6. At least one, preferably a pair of two front cylinder-guide posts 7 are separated a design distance apart with bottom sections attached to the mobile car crusher 1 proximate the front base section 2 and have guideways 8 extended vertically upward from the bottom section of the pair of front cylinder-guide posts 7. Oppositely disposed aft of the car-crusher section 4, at least one, preferably a pair of two rear cylinder-guide posts 9 are separated a design distance apart with bottom sections attached to the mobile car crusher 1 proximate the rear base section 3 and have guideways 8 extended vertically upward from the bottom section of the pair of rear cylinder-guide posts 9. The mobile platform is preferably but not necessarily a low-boy type of semitrailer with highway types of rear wheels 10 under the rear base section 3 and a fifth wheel 11 to which a rear end 12 of a truck tractor can be attached for mobility.

At least one, preferably a single, front hydraulic cylinder 13 is positioned for hydraulic operation and vertical movement selectively proximate the front base section 2. The front hydraulic cylinder 13 has a cylinder base 14 on a bottom end, a cylinder head 15 on a top end, a hydraulic piston 16 in sliding-sealed contact with an internal periphery of a cylinder wall and a piston shaft 17 attached to a bottom end of the hydraulic piston 16. The piston shaft 17 has a linear outside perimeter designedly smaller than the internal periphery of the cylinder wall of the front hydraulic cylinder 13 and is in sliding-sealed contact with an internal periphery of a shaft orifice 18 in the cylinder base 14. A piston-attachment end of the piston shaft 17 is attached to the hydraulic piston 16 and a crusher-hood end of the piston shaft 17 is attached to a front shaft base 19. The front shaft base 19 is in roller contact with the guideways 8 intermediate the front cylinder-guide posts 7.

Oppositely disposed proximate the rear base section 3, at least one, preferably a single, rear hydraulic cylinder 20 is positioned for hydraulic operation and vertical movement selectively. The rear hydraulic cylinder 20 also has a cylinder base 14 on a bottom end, a cylinder head 15 on a top end, a hydraulic piston 16 in sliding-sealed contact with an internal periphery of a cylinder wall and a piston shaft 17 attached to a bottom end of the hydraulic piston 16. The piston shaft 17 has a linear outside perimeter designedly smaller than the internal periphery of the cylinder wall of the rear hydraulic cylinder 20 and is in sliding-sealed contact with an internal periphery of a shaft orifice 18 in the cylinder base 14. A piston-attachment end of the piston shaft 17 is attached to the hydraulic piston 16 and a crusher-hood end of the piston shaft 17 is attached to a rear shaft base 21. The rear shaft base 21 likewise is in roller contact with the guideways 8 intermediate the rear cylinder-guide posts 9.

A crusher floor 22 is extended designedly intermediate the front base section 2 and the rear base section 3. The crusher floor 22 can be designedly thick and sturdy with a crusher surface 23 sized and shaped to receive production automobiles for crushing. A crusher bottom 24 is designedly proximate a bottom of the car-crusher section 4. A first side of the crusher floor 22 is proximate the first side 5 and a second side of the crusher floor 22 is proximate a second side 6 of the mobile car crusher 1. A material restrainer to prevent side travel or escape of cars and parts of cars being crushed can include a front-end wall 25 on opposite sides of the pair of front cylinder-guide posts 7, a rear-end wall 26 on opposite sides of the pair of rear cylinder-guide posts 9 and a back-side wall 27 designedly intermediate the front-end wall 25 and the rear-end wall 26 on the second side of the crusher floor 22 that is proximate the second side 6 of the mobile car crusher 1.

A crusher hood 28 has a front end attached to a crusher-hood side of the front shaft base 19, a rear end attached to a crusher-hood side of the rear shaft base 21, a first side 29 and a second side 30. Width of the crusher hood 28 between the first side 29 and the second side 30 can be designedly narrower than the crusher floor 22. Exterior sides and ends of the crusher hood 28 can be slanted outwardly to center cars being crushed with an inward cam action as the crusher hood 28 is pressured down against tops of cars 44 on the crusher floor 22. Hydraulic fluid under design pressure is provided by a source of hydraulic fluid such as an engine or motor 31, a pump 32 and fluid conveyances 33 having fluid communication to and from a pressure tank 34 with desired pressure: intermediate a head section 35 of the front hydraulic cylinder 13 and the pressure tank 34; intermediate a head section 35 of the rear hydraulic cylinder 20 and the pressure tank 34; intermediate a base section 36 of the front hydraulic cylinder 13 and the pressure tank 34; and intermediate a base section 36 of the rear hydraulic cylinder 20 and the pressure tank 34. Controls at a control unit 37 can be operated directly, remotely and/or variously automatic for directing hydraulic fluid through the conveyances 33 under desired pressure to and from the pressure tank 34. A fuel tank 38 can be positioned conveniently near the source of hydraulic fluid if an engine is utilized in place of a motor for the engine or motor 31.

Pressure of hydraulic fluid conveyed from the source of hydraulic fluid to head sections 35 of the hydraulic cylinders 13 and 20 forces hydraulic pistons 16 downwardly. Pressure of hydraulic fluid conveyed from the source of hydraulic fluid to base sections 36 of the hydraulic cylinders 13 and 20 forces hydraulic pistons 16 upwardly. This positions bases 19 and 21 of the hydraulic cylinders 13 and 20 vertically on guideways 8 for operating the crusher hood 28 in material-crushing downward travel and in material-acceptance upward travel.

Referring to FIGS. 4–7, front and rear cylinder bases 14 are locked into design positions of height on the pair of front cylinder-guide posts 7 and rear cylinder-guide posts 9 respectively by front and rear cylinder-base locks 39. The front and rear cylinder-base locks 39 can be selected from a variety of retainer and locking means such as a clevis pin 40 or shaft in a retainer orifice 41 as shown or more complicated means for securing the cylinder bases 14 in working relationship to design positions of height on the cylinder-guide posts 7 and 9. For some applications, the cylinder-base locks can be latches that are remotely operable either electrically, mechanically or hydraulically to lock and to unlock the cylinder bases 14 in secured relationship to the cylinder-guide posts 7 and 9.

In this embodiment, cylinder-base slide members 42 are extended from opposite sides of the cylinder bases 14 to travel vertically in cylinder-base channels 43 in internally facing sides of the cylinder-guide posts 7 and 9. Vertical travel of the cylinder-base slide members 42 in the cylinder-base channels 43 is between operative mode with the cylinder bases 14 proximate tops of the cylinder-guide posts 7 and 9 for operative mode and proximate bottoms of the cylinder-guide posts 7 and 9 for travel mode of the mobile car crusher 1. The cylinder-base slide members 42 are preferably cylindrical shafts as depicted or have arcuate surfaces on at least a bottom edge to allow pivoting of the cylinder bases 14 in response to selectively different heights of opposite ends of the crusher hood 28 as depicted in FIG. 7.

Figure 7:
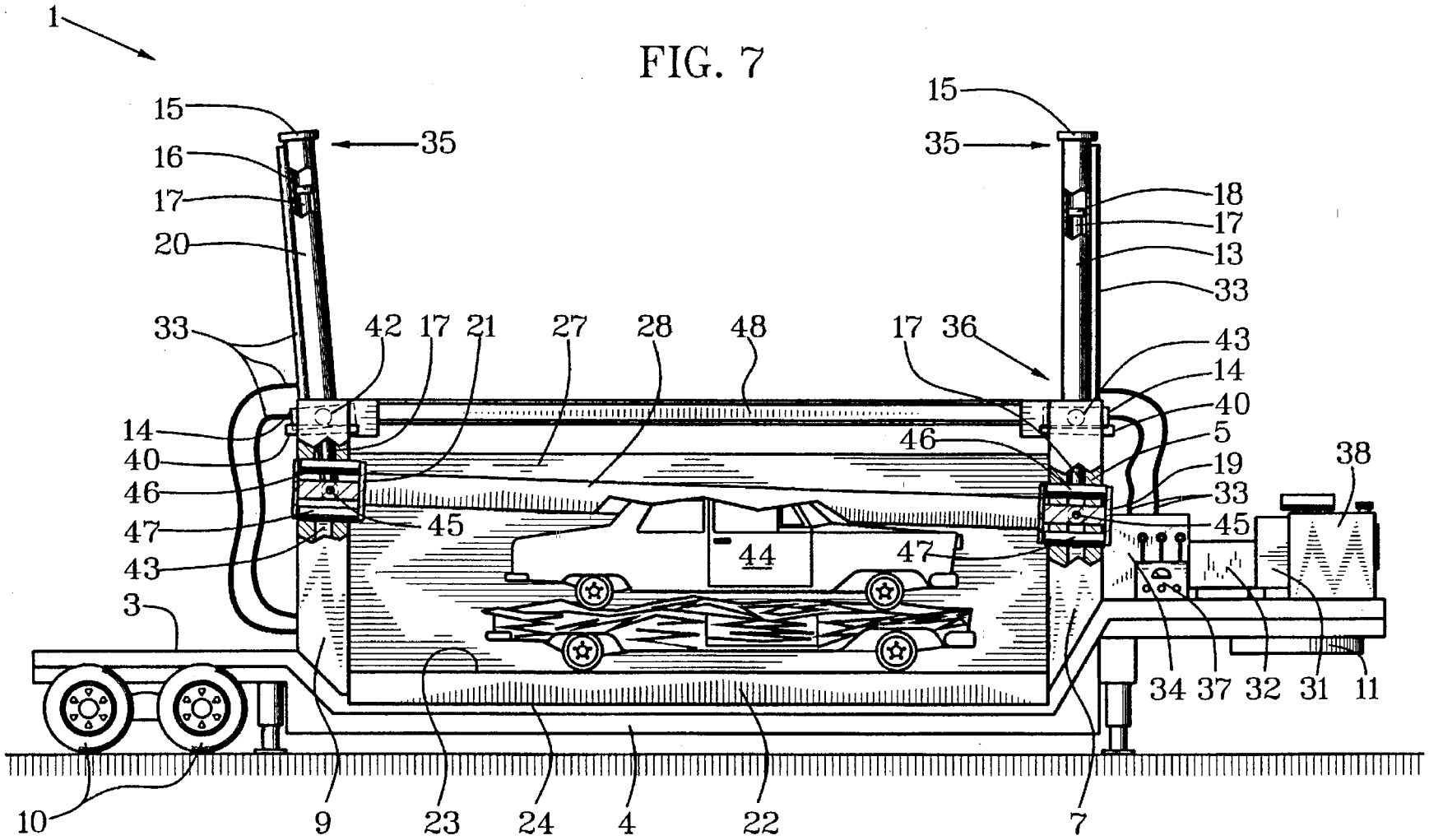
FIG. 7 is a partially cutaway side elevation view in car-crushing operative mode with cylinders maintained in operative mode while being allowed to tilt for selective leverage tilting of a crusher hood.

In operative mode for crushing cars 44 as shown in FIGS. 1 and 7, the crusher hood 28 can be at different heights at opposite ends to concentrate crushing at a low point with mechanical advantage of Class II leverage. The piston shafts 17 being attached pivotally to the shaft bases 19 and 21 at pivot joints 45 and the crusher hood 28 being attached rigidly to the shaft bases 19 and 21, a slight travel of the shaft bases 19 and 21 forwardly and rearwardly will occur when either of shaft bases 19 or 21 are higher than the other.

Figures 4, 5, 6:
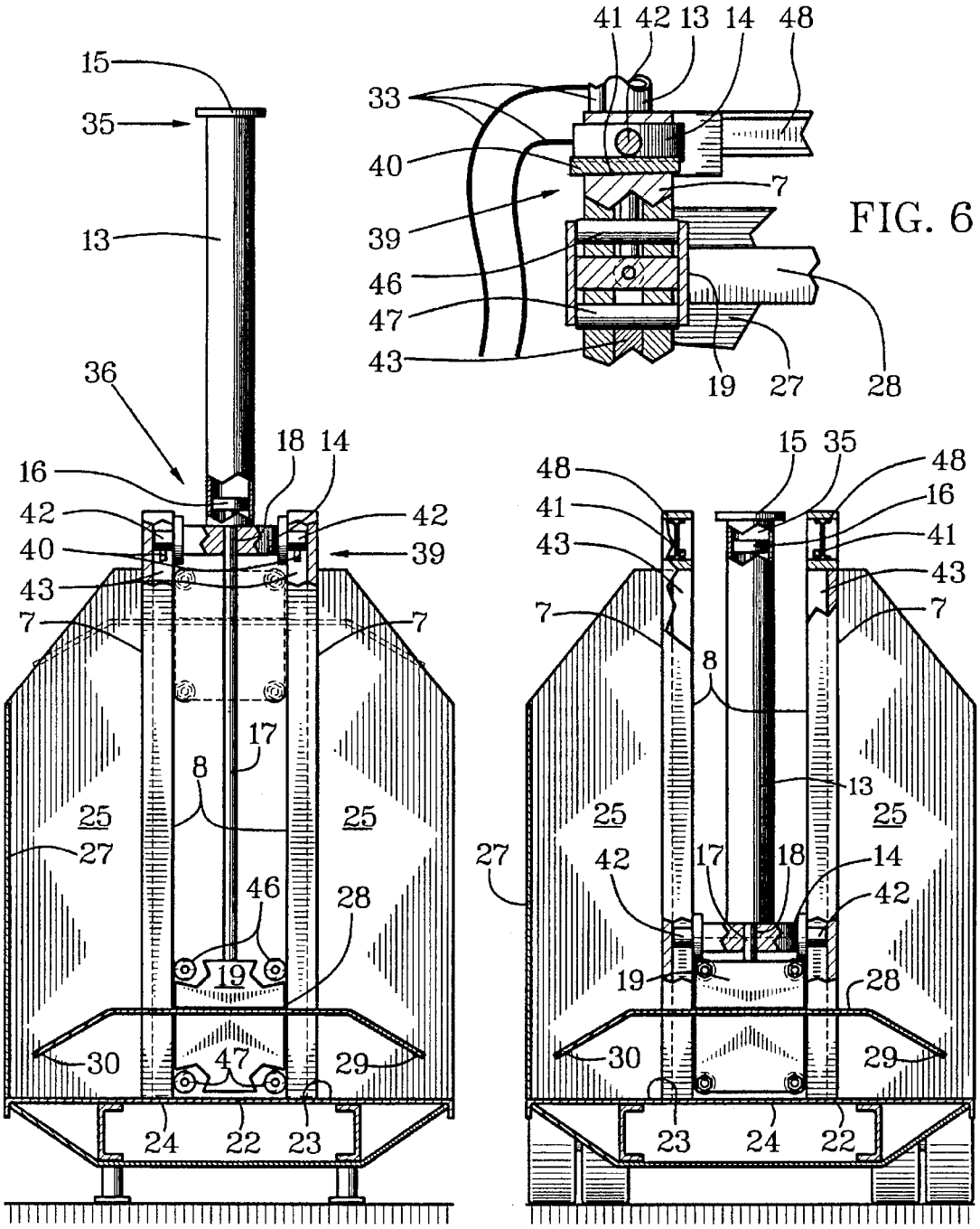
FIG. 4 is a partially cutaway rear view from a position aft of a front hydraulic cylinder in operative mode.
FIG. 5 is a partially cutaway rear view from a cross section in FIG. 3 at a position aft of a front hydraulic cylinder in travel mode.
FIG. 6 is a partially cutaway fragmentary view of a rear cylinder base maintained in operative mode with a lock latch at a top of a rear cylinder-guide post.

The crusher hood 28 is maintained in horizontal attitude laterally from-side-to-side by rigid attachment to the shaft bases 19 and 21 which are in roller contact with guideways 8 on internally facing sides of the cylinder-guide posts 7 and 9 respectively. Roller contact of the shaft bases 19 and 21 is provided with preferably two top rollers 46 and two bottom rollers 47 on each of the shaft bases 19 and 21 as illustrated in FIG. 4. The rollers 46 and 47 are designedly separated vertically to prevent lateral rotation of the crusher hood 28 by arresting lateral rotation of the shaft bases 19 and 20.

Figure 8:
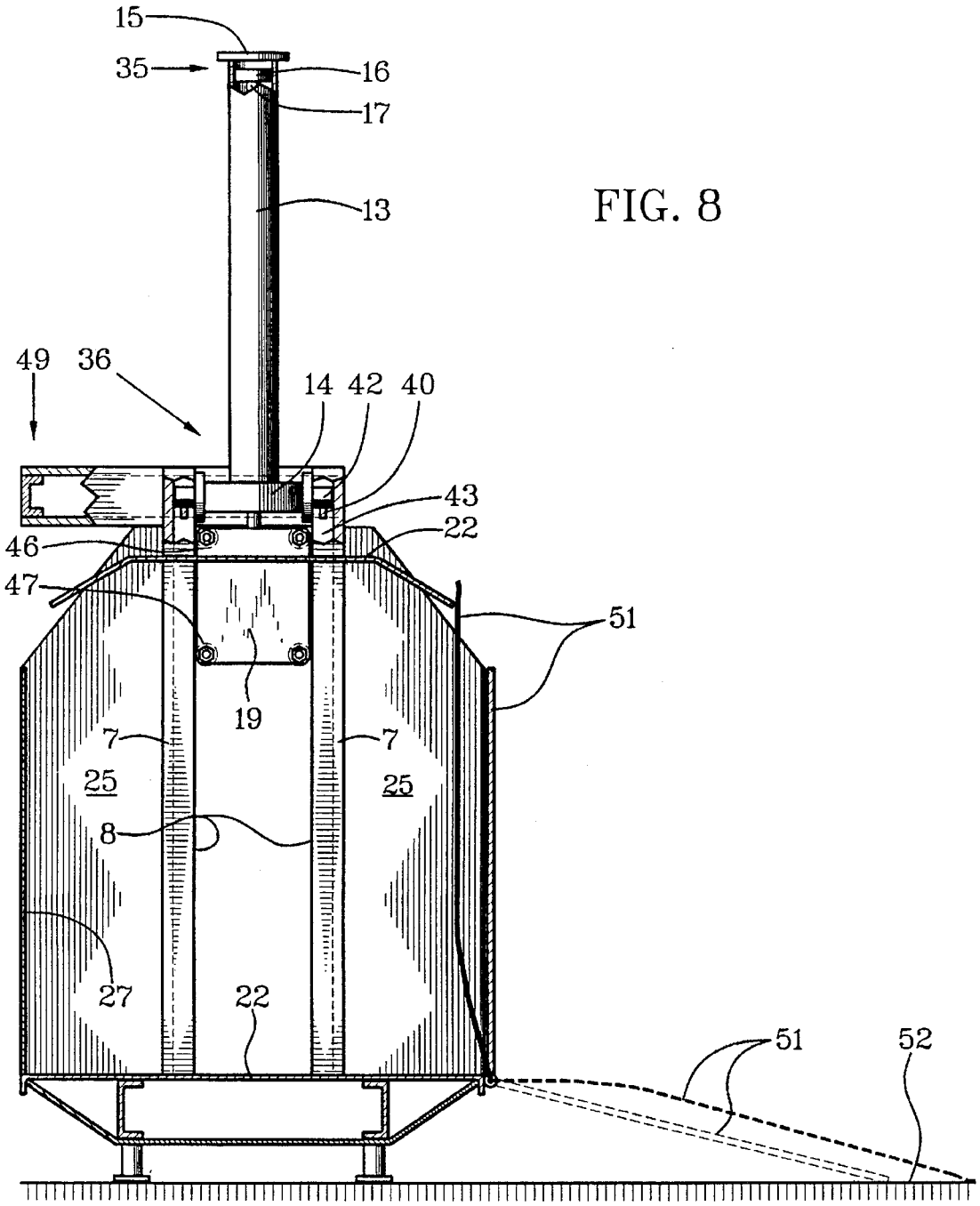
FIG. 8 is a partially cutaway rear view from a position aft of a front hydraulic cylinder in operative mode of an embodiment with design types of optional front-side walls that are pivotal between loading and crushing positions.
Figure 9:
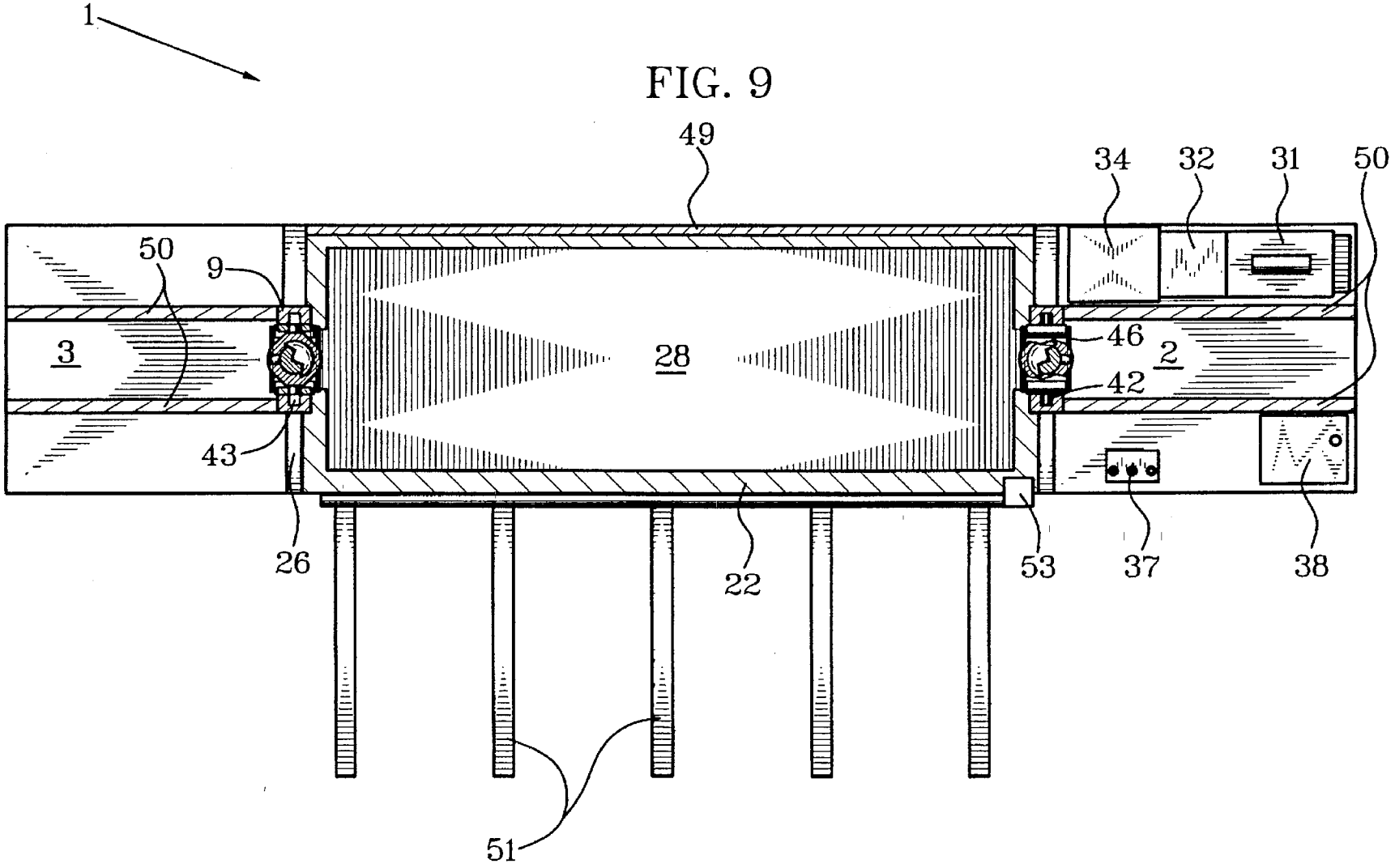
FIG. 9 is a partially cutaway top view of an embodiment with a guide-post brace extended above and beside a crusher floor and a lined front-side wall that is extended in a ramp or loading position.
Figure 10:
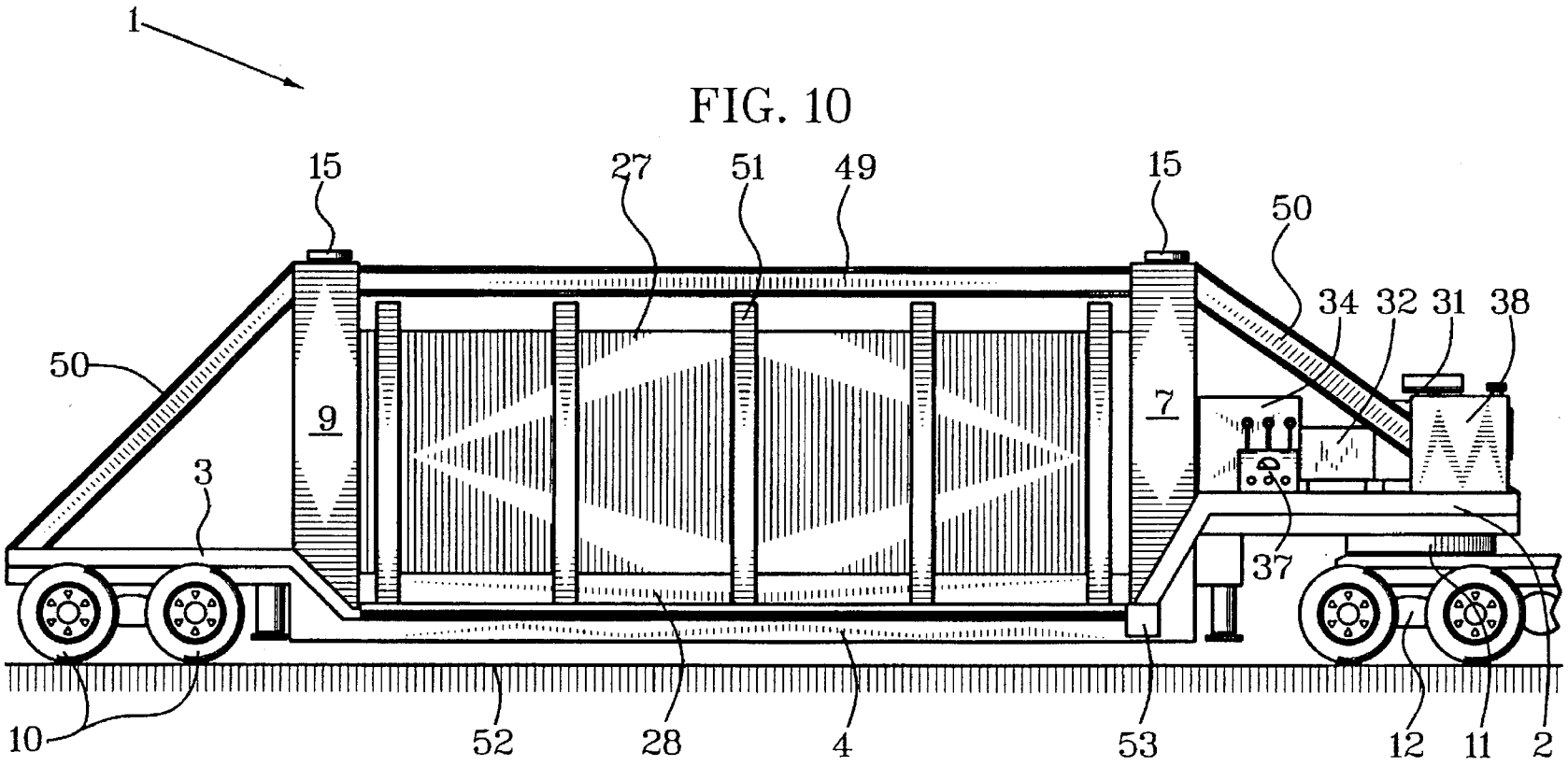
FIG. 10 is the FIG. 9 illustration in travel mode.

As illustrated in FIGS. 1–3 and 5–7, at least one guide-post beam or brace, such as two I-beams 48 or other structural beams for different design preferences can be provided intermediate the pairs of front cylinder-guide posts 7 and the pairs of rear cylinder-guide posts 9. However, for (a) structuring the crusher hood 28 with tapered ends and sides to center cars 44 with cam action of the tapered sides of the crusher hood 28 with less reliance on positioning the cars 44 with forklifts or other car-loading machinery and for (b) increasing heights, telescopically or otherwise, on the cylinder-guide posts 7 and 9 at which the cylinder bases 14 can be positioned, a guide-post beam 49 can be positioned vertically above and designedly beside the crusher floor 22 as illustrated in FIGS. 8–10. Further supportive of the cylinder-guide posts 7 and 9 can be brace beams 50 as depicted extending between tops of the cylinder-guide posts 7 and 9 and opposite ends of the mobile car crusher 1 in FIGS. 9–10.

Referring further to FIGS. 8–10, the material restrainer can have a front-side wall 51 that is pivotal down to a ramp position with a top edge resting on a ground surface 52 in front of the mobile car crusher 1. It is pivotal up to a material-restrainer position with the top edge projecting vertically above the crusher floor 22 and outside of a front edge of the crusher hood 28. The ramp position is depicted with dashed lines in FIG. 8 and with solid lines in FIG. 9. The material-restrainer position is depicted with solid lines in FIGS. 8 and 10.

The front-side wall 51 can be variously constructed and shaped with either tined or flat surfaces. Tined configuration is preferable for allowing front wheels of forklifts of various types to be positioned next to the crusher floor 22 between tines of the front-side wall 51 for loading cars 44 onto the crusher floor 22. Tines can be either rigid or leaf-spring members with design configuration as illustrated. With the front-side wall 51 to keep doors and other components of cars 44 from projecting out when crushing action occurs, labor and material time can be saved by a loader's picking up other cars instead of standing by to keep parts of the cars 44 under the crusher hood 28.

The front-side wall 51 can be hinged on an axle that is operated with retainer gearing 53. It can be either manually, electrically, hydraulically or pneumatically operated designedly.

Figure 11:
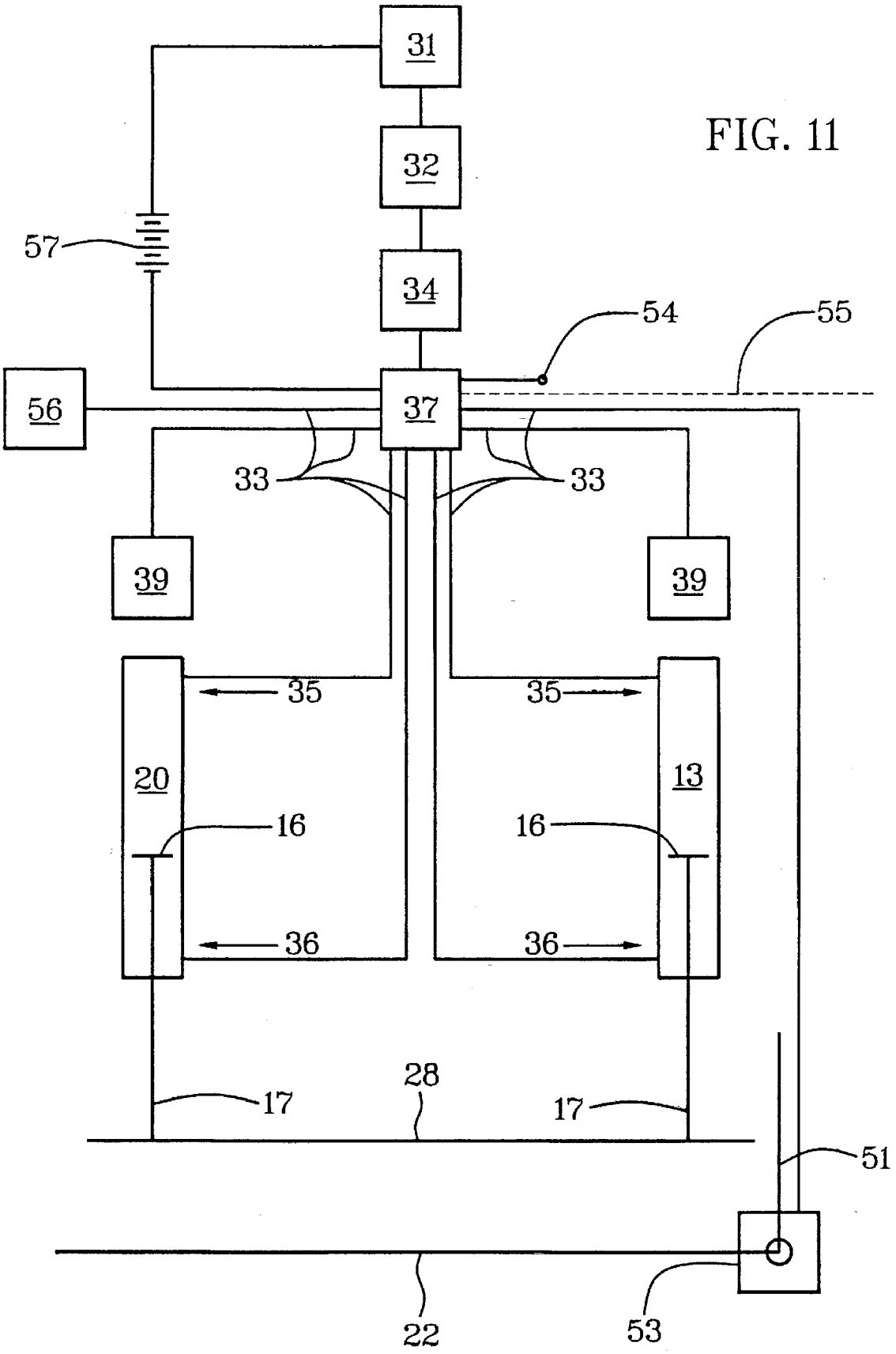
FIG. 11 is a schematic diagram of a control system in relation to operative components.

Referring to FIG. 11, operative control of components is illustrated in a schematic diagram starting with the engine or motor 31 which operates the hydraulic pump 32 for providing hydraulic fluid under pressure to the pressure tank 34. The control unit 37 directs hydraulic fluid to and from operative units in response to designedly manual, automatic, and/or remote controls. Manual and automatic controls are represented by a handle 54 and remote control is represented by a radio-signal line 55 that is dashed. Solid lines intermediate the control unit 37 and numerically identified components represent fluid conveyances 33 in fluid communication between hydraulic components and the control unit 37.

Hydraulic fluid directed through fluid conveyances 33 to head sections 35 forces hydraulic pistons 16 down, either to (a) raise the hydraulic cylinders 13 and 20 to operative mode or (b) to operate the crusher hood 28 in downward material-crushing travel. Hydraulic fluid directed through fluid conveyances 33 to base sections 36 raises the hydraulic pistons 16 to operate the crusher hood 28 in upward material-acceptance travel. Hydraulic fluid at opposite ends of the hydraulic cylinders 13 and 20 from which hydraulic fluid is being directed returns in opposite-directional flow to the pressure tank 34. The optional front-side wall 51, if installed and used, is operated by the retainer gearing 53 with hydraulics that can be unidirectional or bidirectional through fluid conveyances 33 from the control unit 37. Similarly, hydraulic control of the front and rear cylinder-base locks 39 if used can be unidirectional or bidirectional through fluid conveyances 33 from the control unit 37. Other hydraulic components 56 if used, also can be unidirectional or bidirectional through fluid conveyances 33 from the control unit 37. An electrical source 57, such as a generator or battery powered by the engine or motor 31, can be provided for operating the control unit 37 and radio signals at the radio-signal line 55.

A new and useful mobile car crusher having been described, all such modifications, adaptations, substitutions of equivalents, mathematical possibilities of combinations of parts, pluralities of parts, applications and forms thereof as described by the following claims are included in this invention.

I claim:

1. A mobile car crusher comprising:

a mobile platform with a front base section, a rear base section, a car-crusher section intermediate the front base section and the rear base section, a first side and a second side of the mobile car crusher;

at least one first shaft guide having a bottom section attached to the mobile car crusher proximate the front base section of the mobile car crusher and having guideways extended vertically upward from the bottom section of the at-least-one first shaft guide;

at least one second shaft guide having a bottom section attached to the mobile car crusher proximate the rear base section of the mobile car crusher and having guideways extended vertically upward from the bottom section of the at-least-one second shaft guide;

at least one first hydraulic cylinder that is positioned for hydraulic operation and vertical movement selectively proximate the front base section of the mobile car crusher and that has a cylinder base on a bottom end, a cylinder head on a top end, a hydraulic piston in sliding sealed contact with an internal periphery of a cylindrical wall of the at-least-one first hydraulic cylinder, a piston shaft attached to a bottom end of the hydraulic piston, the piston shaft having a linear outside perimeter designedly smaller than the internal periphery of the cylindrical wall of the at-least-one first hydraulic cylinder, the piston shaft being in sliding sealed contact with an internal periphery of a shaft orifice in the cylinder base of the at-least-one first hydraulic cylinder and the piston shaft having a crusher-hood end opposite a piston-attachment end of the piston shaft;

at least one first shaft base in design roller contact with the guideways which are extended vertically upward from the bottom section of the at-least-one first shaft guide;

the crusher-hood end of the piston shaft of the at-least-one first hydraulic cylinder being attached to the at-least-one first shaft base;

at least one second hydraulic cylinder that is positioned for hydraulic operation and vertical movement selectively proximate the rear base section of the mobile car crusher and that has a cylinder base on a bottom end, a cylinder head on a top end, a hydraulic piston in sliding sealed contact with an internal periphery of a cylindrical wall of the at-least-one second hydraulic cylinder, a piston shaft attached to a bottom end of the hydraulic piston, the piston shaft having a linear outside perimeter designedly smaller than the internal periphery of the cylindrical wall of the at-least-one second hydraulic cylinder, the piston shaft being in sliding sealed contact with an internal periphery of a shaft orifice in the cylinder base of the at-least-one second hydraulic cylinder and the piston shaft having a crusher-hood end opposite a piston-attachment end of the piston shaft;

at least one second shaft base in design roller contact with the guideways which are extended vertically upward from the bottom section of the at-least-one second shaft guide;

the crusher-hood end of the piston shaft of the at-least-one second hydraulic cylinder being attached to the at-least-one second shaft base;

a crusher floor extended designedly intermediate the front base section and the rear base section of the mobile car crusher and having a crusher surface, a bottom proximate the bottom of the car-crusher section of the mobile car crusher, a first side proximate a first side of the car-crusher section of the mobile car crusher, a second side proximate a second side of the car-crusher section of the mobile car crusher, a material restrainer on at least one side of the crusher floor, a first end proximate an inside end of the front base section of the mobile car crusher and a second end proximate an inside end of the rear base section of the mobile car crusher;

a crusher hood having a first end attached designedly to a crusher-hood side of the at-least-one first shaft base, a second end attached designedly to a crusher-hood side of the at-least-one second shaft base, a first side, a second side, and a crusher section of the crusher hood positioned linearly intermediate the first end and the second end and laterally intermediate the first side and the second side designedly above the crusher floor vertically;

a source of hydraulic fluid having selectively controllable pressure of hydraulic fluid in fluid conveyances having fluid communication intermediate a head section of the at-least-one first hydraulic cylinder and the source of hydraulic fluid, intermediate a head section of the at-least-one second hydraulic cylinder and the source of hydraulic fluid, intermediate a base section of the at-least-one first hydraulic cylinder and the source of hydraulic fluid and, intermediate a base section of the at-least-one second hydraulic cylinder and the source of hydraulic fluid, and controls for operating the source of hydraulic fluid, such that pressure of hydraulic fluid conveyed from the source of hydraulic fluid to head sections of hydraulic cylinders forces hydraulic pistons downwardly and pressure of hydraulic fluid conveyed from the source of hydraulic fluid to base sections of the hydraulic cylinders forces hydraulic pistons upwardly to actuate piston shafts upwardly and downwardly for positioning bases of the hydraulic cylinders vertically in design contact with shaft guides and for operating the crusher hood in material-crushing downward travel and in material-acceptance upward travel;

at least one first cylinder-base lock in position-lockable relationship between the cylinder base of the at-least-one first hydraulic cylinder and the at-least-one first shaft guide proximate at least one design position of height on the at-least-one first shaft guide; and at least one second cylinder-base lock in position-lockable relationship between the cylinder base of the at-least-one second hydraulic cylinder and the at-least-one second shaft guide proximate at least one design position of height on the at-least-one second shaft guide, such that for positioning hydraulic cylinders in operative mode, the hydraulic cylinders can be raised to desired positions of height in relation to shaft guides by positioning shaft bases proximate bottoms of the shaft guides and conveying hydraulic fluid under pressure from the source of hydraulic fluid to base sections of the hydraulic cylinders, such that for maintaining positioning in operative mode, the cylinder bases can be locked to the shaft guides at design heights with the cylinder-base locks for operating the crusher hood in material-crushing downward travel and in material-acceptance upward travel, and further such that for lowering the hydraulic cylinders to travel mode, the cylinder bases can be unlocked from the shaft guides with the cylinder-base locks and pressure of hydraulic fluid conveyed to base sections of the hydraulic cylinders can be decreased in proportion to pressure of hydraulic fluid conveyed to head sections of the hydraulic cylinders.

2. A mobile car crusher as described in claim 1 wherein:

the mobile platform is a semitrailer having design structural strength.

3. A mobile car crusher as described in claim 2 wherein:

the semitrailer is a lowboy type having a sunken central section in the car-crusher section, a front raised section vertically above a fifth-wheel attachment in the front base section and a rear raised section proximate rear wheels in the rear base section.

4. A mobile car crusher as described in claim 1 wherein:

the at-least-one first hydraulic cylinder is a front hydraulic cylinder;

the at-least-one second hydraulic cylinder is a rear hydraulic cylinder;

the at-least-one first shaft base is a front shaft base;

the at-least-one second shaft base is a rear shaft base;

the at-least-one first shaft guide is a pair of front cylinder-guide posts separated a design distance apart for receiving the front shaft base between them; and the at-least-one second shaft guide is a pair of rear cylinder-guide posts separated a design distance apart for receiving the rear shaft base between them.

5. A mobile car crusher as described in claim 4 wherein:

the at-least-one first cylinder-base lock is a front cylinder-base lock in position-lockable relationship between the front shaft base and the pair of front cylinder-guide posts; and the at-least-one second cylinder-base lock is a rear cylinder-base lock in position-lockable relationship between the rear shaft base and the pair of rear cylinder-guide posts.

6. A mobile car crusher as described in claim 4 wherein:

the material restrainer on at least one side of the crusher floor has a front-end wall positioned designedly on opposite sides of the pair of front cylinder-guide posts, a rear-end wall positioned designedly on opposite sides of the pair of rear cylinder guide posts and a back-side wall positioned designedly intermediate the front-end wall and the rear-end wall on the second side of the crusher floor.

7. A mobile car crusher as described in claim 6 wherein:

the material restrainer has a front-side wall with a bottom edge attached pivotally to the first side of the mobile car crusher proximate the crusher surface of the crusher floor and extending designedly intermediate the front base section and the rear base section on the first side of the crusher floor; and the front side wall being pivotal down to a ramp position with a top edge resting on a ground surface in front of the mobile car crusher and being pivotal up to a material-restrainer position with an inside surface in material-restraining relationship to cars being crushed by operation of the crusher hood within inside walls of the material restrainer.

8. A mobile car crusher as described in claim 4 and further comprising:

at least one guide-post beam in bracing relationship between the mobile car crusher, the front cylinder-guide posts and the rear cylinder-guide posts.

9. A mobile car crusher as described in claim 8 wherein:

the at-least-one guide-post beam is at least one structural beam extended intermediate a top of the front cylinder-guide posts and a top of the rear cylinder-guide posts at a position vertically above the crusher hood.

10. A mobile car crusher as described in claim 8 wherein:

the at-least-one guide-post beam is at least one structural beam extended intermediate a top of the front cylinder-guide posts and a top of the rear cylinder-guide posts at a position vertically above and designedly beside the crusher floor.

11. A mobile car crusher as described in claim 10 wherein:

the material restrainer on at least one side of the crusher floor has a front-end wall positioned designedly on opposite sides of the pair of front cylinder-guide posts, a rear-end wall positioned designedly on opposite sides of the pair of rear cylinder guide posts and a back-side wall positioned designedly intermediate the front-end wall and the rear-end wall on the second side of the crusher floor.

12. A mobile car crusher as described in claim 11 wherein:

the material restrainer has a front-side wall with a bottom edge attached pivotally to the first side of the mobile car crusher proximate the crusher surface of the crusher floor and extending designedly intermediate the front base section and the rear base section on the first side of the crusher floor; and the front side wall is pivotal down to a ramp position with a top edge resting on a ground surface in front of the mobile car crusher and is pivotal up to a material-restrainer position with an inside surface in material-restraining relationship to cars being crushed by operation of the crusher hood within inside walls of the material restrainer.

13. A mobile car crusher as described in claim 12 wherein:

the front-side wall is tined from the bottom edge up to the top edge; and tines of the front-side wall are separated designedly, such that wheels of fork lifts and other equipment can approach the first side of the mobile car crusher between the tines for positioning cars on the crusher floor to be crushed when the front-side wall is pivoted down to a ramp position when cars are being loaded onto the crusher floor and the tines can prevent side escape of cars and components of cars from under the crusher hood when the front-side wall is pivoted to a vertical position during crushing action of the crusher hood.

14. A mobile car crusher as described in claim 8 wherein:

the material restrainer on at least one side of the crusher floor has a front-end wall positioned designedly on opposite sides of the pair of front cylinder-guide posts, a rear-end wall positioned designedly on opposite sides of the pair of rear cylinder guide posts and a back-side wall positioned designedly intermediate the front-end wall and the rear-end wall on the second side of the crusher floor.

15. A mobile car crusher as described in claim 14 wherein:

the material restrainer has a front-side wall with a bottom edge attached pivotally to the first side of the mobile car crusher proximate the crusher surface of the crusher floor and extending designedly intermediate the front base section and the rear base section on the first side of the crusher floor; and the front side wall is pivotal down to a ramp position with a top edge resting on a ground surface in front of the mobile car crusher and is pivotal up to a material-restrainer position with an inside surface in material-restraining relationship to cars being crushed by operation of the crusher hood within inside walls of the material restrainer.

16. A mobile car crusher as described in claim 4 wherein:

the front cylinder-guide posts and the rear cylinder-guide posts have cylinder-base channels in internally facing sides that receive cylinder-base slide members in vertical travel of the cylinder base on the bottom end of the front hydraulic cylinder and in vertical travel of the cylinder base on the bottom end of the rear hydraulic cylinder intermediate travel-mode positions at bottoms and operative-mode positions at tops of the front cylinder-guide posts and the rear cylinder-guide posts respectively.

17. A mobile car crusher as described in claim 16 wherein:

the at-least-one first cylinder-base lock is a latch member in position-lockable latching relationship between the front hydraulic cylinder and at least one cylinder-base slide member in operative-mode position at tops of the front cylinder-guide posts; and the at-least-one second cylinder-base lock is a latch member in position-lockable latching relationship between the rear hydraulic cylinder and at least one cylinder-base slide member in operative-mode position at tops of the rear cylinder-guide posts.

18. A mobile car crusher as described in claim 4 wherein:

the design roller contact of the front shaft base with the guideways is with at least two top rollers attached rotatively to opposite sides of a top portion of the front shaft base and at least two bottom rollers attached rotatively to opposite sides of a bottom portion of the front shaft base;

one top roller and one bottom roller attached rotatively to one side of the top portion of the front shaft base being in rotative contact with a guideway on a guideway side of one of the pair of front cylinder-guide posts;

an oppositely disposed top roller and an oppositely disposed bottom roller attached rotatively to an oppositely disposed side of the top portion of the front shaft base being in rotative contact with a guideway on a guideway side of an oppositely disposed one of the pair of front cylinder-guide posts;

the design roller contact of the rear shaft base with the guideways is with at least two top rollers attached rotatively to opposite sides of a top portion of the rear shaft base and at least two bottom rollers attached rotatively to opposite sides of a bottom portion of the rear shaft base;

one top roller and one bottom roller attached rotatively to one side of the top portion of the rear shaft base being in rotative contact with a guideway on a guideway side of one of the pair of rear cylinder-guide posts; and an oppositely disposed top roller and an oppositely disposed bottom roller attached rotatively to an oppositely disposed side of the top portion of the rear shaft base being in rotative contact with a guideway on a guideway side of an oppositely disposed one of the pair of rear cylinder-guide posts.

19. A mobile car crusher as described in claim 18 wherein:

the top rollers and the bottom rollers are designedly rubberlike.

20. A mobile car crusher as described in claim 1 wherein:

design attachment of the first end of the crusher hood to the crusher-hood side of the at-least-one first shaft base is pivotal; and design attachment of the second end of the crusher hood to the crusher-hood side of the at-least-one second shaft base is pivotal.

21. A mobile car crusher comprising:

a mobile platform having a front base section, a rear base section, a car-crusher section intermediate the front base section and the rear base section, a first side and a second side of the mobile car crusher;

a pair of front cylinder-guide posts separated a design distance apart with bottom sections attached to the mobile car crusher proximate the front base section of the mobile car crusher and having guideways extended vertically upward from the bottom section of the pair of front cylinder-guide posts;

a pair of rear cylinder-guide posts separated a design distance apart with bottom sections attached to the mobile car crusher proximate the rear base section of the mobile car crusher and having guideways extended vertically upward from the bottom section of the pair of rear cylinder-guide posts;

a front hydraulic cylinder that is positioned for hydraulic operation and vertical movement selectively proximate the front base section of the mobile car crusher and that has a cylinder base on a bottom end, a cylinder head on a top end, a hydraulic piston in sliding sealed contact with an internal periphery of a cylindrical wall of the front hydraulic cylinder, a piston shaft attached to a bottom end of the hydraulic piston, the piston shaft having a linear outside perimeter designedly smaller than the internal periphery of the cylindrical wall of the front hydraulic cylinder, the piston shaft being in sliding sealed contact with an internal periphery of a shaft orifice in the cylinder base of the front hydraulic cylinder and the piston shaft having a crusher-hood end opposite a piston-attachment end of the piston shaft;

a front shaft base in roller contact with the guideways which are extended vertically upward from the bottom section of the pair of front cylinder-guide posts;

the crusher-hood end of the piston shaft of the front hydraulic cylinder being attached to the front shaft base;

a rear hydraulic cylinder that is positioned for hydraulic operation and vertical movement selectively proximate the rear base section of the mobile car crusher and that has a cylinder base on a bottom end, a cylinder head on a top end, a hydraulic piston in sliding sealed contact with an internal periphery of a cylindrical wall of the rear hydraulic cylinder, a piston shaft attached to a bottom end of the hydraulic piston, the piston shaft having a linear outside perimeter designedly smaller than the internal periphery of the cylindrical wall of the rear hydraulic cylinder, the piston shaft being in sliding sealed contact with an internal periphery of a shaft orifice in the cylinder base of the rear hydraulic cylinder and the piston shaft having a crusher-hood end opposite a piston-attachment end of the piston shaft;

a rear shaft base in roller contact with the guideways which are extended vertically upward from the bottom section of the pair of rear cylinder-guide posts;

the crusher-hood end of the piston shaft of the rear hydraulic cylinder being attached to the rear shaft base;

a crusher floor extended designedly intermediate the front base section and the rear base section of the mobile car crusher and having a crusher surface, a bottom proximate the bottom of the car-crusher section of the mobile car crusher, a first side proximate a first side of the car-crusher section of the mobile car crusher, a second side proximate a second side of the car-crusher section of the mobile car crusher, a material restrainer on at least one side of the crusher floor, a front end proximate an inside end of the front base section of the mobile car crusher and a rear end proximate an inside end of the rear base section of the mobile car crusher;

a crusher hood having a front end attached designedly to a crusher-hood side of the front shaft base, a rear end attached designedly to a crusher-hood side of the rear shaft base, a first side, a second side, and a crusher section of the crusher hood positioned linearly intermediate the front end and the rear end and laterally intermediate the first side and the second side designedly above the crusher floor vertically;

a source of hydraulic fluid having selectively controllable pressure of hydraulic fluid in fluid conveyances having fluid communication intermediate a head section of the front hydraulic cylinder and the source of hydraulic fluid, intermediate a head section of the rear hydraulic cylinder and the source of hydraulic fluid, intermediate a base section of the front hydraulic cylinder and the source of hydraulic fluid and, intermediate a base section of the rear hydraulic cylinder and the source of hydraulic fluid, and controls for operating the source of hydraulic fluid, such that pressure of hydraulic fluid conveyed from the source of hydraulic fluid to head sections of hydraulic cylinders forces hydraulic pistons downwardly and pressure of hydraulic fluid conveyed from the source of hydraulic fluid to base sections of the hydraulic cylinders forces hydraulic pistons upwardly to actuate piston shafts upwardly and downwardly for positioning bases of the hydraulic cylinders vertically on shaft guides and for operating the crusher hood in material-crushing downward travel and in material-acceptance upward travel;

a front cylinder-base lock in position-lockable relationship between the front shaft base and the pair of front cylinder-guide posts proximate at least one design position of height on the pair of front cylinder-guide posts; and a rear cylinder-base lock in position-lockable relationship between the rear shaft base and the pair of rear cylinder-guide posts proximate at least one design position of height on the pair of rear cylinder-guide posts, such that for positioning hydraulic cylinders in operative mode, the hydraulic cylinders can be raised to desired positions of height in relation to shaft guides by positioning shaft bases proximate bottoms of shaft guides and conveying hydraulic fluid under pressure from the source of hydraulic fluid to base sections of the hydraulic cylinders, such that for maintaining positioning in operative mode, cylinder bases can be locked to shaft guides at design heights with cylinder-base locks for operating the crusher hood in material-crushing downward travel and in material-acceptance upward travel, and further such that for lowering hydraulic cylinders to travel mode, cylinder bases can be unlocked from shaft guides with cylinder-base locks and pressure of hydraulic fluid conveyed to base sections of hydraulic cylinders can be decreased in proportion to pressure of hydraulic fluid conveyed to head sections of hydraulic cylinders.

22. A mobile car crusher as described in claim 21 wherein:

the at-least-one first cylinder-base lock is a front cylinder-base lock in position-lockable relationship between the front shaft base and the pair of front cylinder-guide posts; and the at-least-one second cylinder-base lock is a rear cylinder-base lock in position-lockable relationship between the rear shaft base and the pair of rear cylinder-guide posts.

23. A mobile car crusher as described in claim 21 wherein:

the material restrainer on at least one side of the crusher floor has a front-end wall positioned designedly on opposite sides of the pair of front cylinder-guide posts, a rear-end wall positioned designedly on opposite sides of the pair of rear cylinder guide posts and a back-side wall positioned designedly intermediate the front-end wall and the rear-end wall on the second side of the crusher floor.

24. A mobile car crusher as described in claim 21 wherein:

the material restrainer has a front-side wall with a bottom edge attached pivotally to the first side of the mobile car crusher proximate the crusher surface of the crusher floor and extending designedly intermediate the front base section and the rear base section on the first side of the crusher floor; and the front side wall being pivotal down to a ramp position with a top edge resting on a ground surface in front of the mobile car crusher and being pivotal up to a material-restrainer position with an inside surface in material-restraining relationship to cars being crushed by operation of the crusher hood within inside walls of the material restrainer.

25. A mobile car crusher as described in claim 24 wherein:

the front-side wall is tined from the bottom edge up to the top edge; and tines of the front-side wall are separated designedly, such that wheels of fork lifts and other equipment can approach the first side of the mobile car crusher between the tines for positioning cars on the crusher floor to be crushed when the front-side wall is pivoted down to a ramp position when cars are being loaded onto the crusher floor and the tines can prevent side escape of cars and components of cars from under the crusher hood when the front-side wall is pivoted to a vertical position during crushing action of the crusher hood.

26. A mobile car crusher as described in claim 21 wherein:

design attachment of the first end of the crusher hood to the crusher-hood side of the front shaft base is pivotal; and design attachment of the second end of the crusher hood to the crusher-hood side of the at-least-one rear shaft base is pivotal.

27. A mobile car crusher as described in claim 21 and further comprising:

at least one guide-post beam in bracing relationship between the mobile car crusher, the front cylinder-guide posts and the rear cylinder-guide posts.

28. A mobile car crusher as described in claim 27 wherein:

the at-least-one guide-post beam is at least one structural beam extended intermediate a top of the front cylinder-guide posts and a top of the rear cylinder-guide posts at a position vertically above the crusher hood.

29. A mobile car crusher as described in claim 27 wherein:

the at-least-one guide-post beam is at least one structural beam extended intermediate a top of the front cylinder-guide posts and a top of the rear cylinder-guide posts at a position vertically above and designedly beside the crusher floor.

30. A mobile car crusher as described in claim 21 wherein:

the front cylinder-guide posts and the rear cylinder-guide posts have cylinder-base channels in internally facing sides that receive cylinder-base slide members in vertical travel of the cylinder base on the bottom end of the front hydraulic cylinder and in vertical travel of the cylinder base on the bottom end of the rear hydraulic cylinder intermediate travel-mode positions at bottoms and operative-mode positions at tops of the front cylinder-guide posts and the rear cylinder-guide posts respectively.

31. A mobile car crusher as described in claim 21 wherein:

the at-least-one first cylinder-base lock is a latch member in position-lockable latching relationship between the front hydraulic cylinder and at least one cylinder-base slide member in operative-mode position at tops of the front cylinder-guide posts; and the at-least-one second cylinder-base lock is a latch member in position-lockable latching relationship between the rear hydraulic cylinder and at least one cylinder-base slide member in operative-mode position at tops of the rear cylinder-guide posts.

32. A mobile car crusher as described in claim 31 wherein:

the top rollers and the bottom rollers are designedly rubberlike.

33. A mobile car crusher as described in claim 21 wherein:

the design roller contact of the front shaft base with the guideways is with at least two top rollers attached rotatively to opposite sides of a top portion of the front shaft base and at least two bottom rollers attached rotatively to opposite sides of a bottom portion of the front shaft base;

one top roller and one bottom roller attached rotatively to one side of the top portion of the front shaft base being in rotative contact with a guideway on a guideway side of one of the pair of front cylinder-guide posts;

an oppositely disposed top roller and an oppositely disposed bottom roller attached rotatively to an oppositely disposed side of the top portion of the front shaft base being in rotative contact with a guideway on a guideway side of an oppositely disposed one of the pair of front cylinder-guide posts;

the design roller contact of the rear shaft base with the guideways is with at least two top rollers attached rotatively to opposite sides of a top portion of the rear shaft base and at least two bottom rollers attached rotatively to opposite sides of a bottom portion of the rear shaft base;

one top roller and one bottom roller attached rotatively to one side of the top portion of the rear shaft base being in rotative contact with a guideway on a guideway side of one of the pair of rear cylinder-guide posts; and an oppositely disposed top roller and an oppositely disposed bottom roller attached rotatively to an oppositely disposed side of the top portion of the rear shaft base being in rotative contact with a guideway on a guideway side of an oppositely disposed one of the pair of rear cylinder-guide posts.

34. A mobile car crusher comprising:

front cylinder-guide posts designedly separated and extended vertically upward from proximate a front section of a mobile platform;

guideways on facing sides of the front cylinder-guide posts;

rear cylinder-guide posts designedly separated and extended vertically upward from proximate a rear section of a mobile platform;

guideways on facing sides of the rear cylinder-guide posts;

a front hydraulic cylinder having a cylinder base with a sliding anchor means in sliding contact with the front cylinder-guide posts;

a rear hydraulic cylinder having a cylinder base with a sliding anchor means in sliding contact with the rear cylinder-guide posts;

a lockable and unlockable top anchor proximate a top of the front cylinder-guide posts in lockable relationship between the sliding anchor means that is in sliding contact with the front cylinder-guide posts and a design position proximate tops of the front cylinder-guide posts; and a lockable and unlockable top anchor proximate a top of the rear cylinder-guide posts in lockable relationship between the sliding anchor means that is in sliding contact with the rear cylinder-guide posts and a design position proximate tops of the rear cylinder-guide posts.

35. A mobile car crusher as described in claim 34 and further comprising:

a front shaft base attached to a piston shaft of a hydraulic piston of the front hydraulic cylinder;

top rollers attached rotatively to a top portion of the front shaft base on opposite sides of the front shaft base and positioned in roller contact with oppositely disposed surfaces of the guideways on the front cylinder-guide posts;

bottom rollers attached rotatively to a bottom portion of the front shaft base on opposite sides of the front shaft base and positioned in roller contact with oppositely disposed surfaces of the guideways on the front cylinder-guide posts;

top rollers attached rotatively to a top portion of the rear shaft base on opposite sides of the rear shaft base and positioned in roller contact with oppositely disposed surfaces of the guideways on the rear cylinder-guide posts;

bottom rollers attached rotatively to a bottom portion of the rear shaft base on opposite sides of the rear shaft base and positioned in roller contact with oppositely disposed surfaces of the guideways on the rear cylinder-guide posts; and a crusher hood having a front end attached to the front shaft base and rear end attached to the rear shaft base.

36. A mobile car crasher as described in claim 35 wherein:

the top rollers and the bottom rollers are designedly rubberlike.

* * * * *